US006517180B2

(12) United States Patent
Tullis et al.

(10) Patent No.: US 6,517,180 B2
(45) Date of Patent: Feb. 11, 2003

(54) DOT SENSING, COLOR SENSING AND MEDIA SENSING BY A PRINTER FOR QUALITY CONTROL

(75) Inventors: Barclay J Tullis, Palo Alto, CA (US); Ross R. Allen, Belmont, CA (US); Jun Gao, Mountain View, CA (US); Carl E Picciotto, Menlo Park, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 96 days.

(21) Appl. No.: 09/819,102

(22) Filed: Mar. 27, 2001

(65) Prior Publication Data

US 2002/0140757 A1 Oct. 3, 2002

(51) Int. Cl.[7] ..... B41J 2/01
(52) U.S. Cl. ..... 347/19
(58) Field of Search ..... 347/19; 358/504, 358/514, 406

(56) References Cited

U.S. PATENT DOCUMENTS

| | | | | |
|---|---|---|---|---|
| 4,328,504 A | | 5/1982 | Weber et al. | 346/75 |
| 5,049,898 A | | 9/1991 | Arthur et al. | 346/1.1 |
| 6,036,298 A | | 3/2000 | Walker | 347/19 |
| 6,188,058 B1 | | 2/2001 | Tullis | 250/208.1 |
| 6,227,644 B1 | * | 5/2001 | Perner | 347/19 |
| 6,419,340 B1 | * | 6/2002 | Wickham et al. | 347/15 |

FOREIGN PATENT DOCUMENTS

| | | | |
|---|---|---|---|
| EP | 0925920 | A | 6/1999 |
| WO | WO9843817 | A | 10/1998 |
| WO | WO99-01012 | A | 1/1999 |
| WO | WO0053420 | A | 9/2000 |

OTHER PUBLICATIONS

Patent Abstract of Japan vol. 200, No. 09, Oct. 13, 2000 and JP 2000 168109 A (Olympus Optical Co Ltd) Jun. 20, 2000 abstract and US 628 027A (Ioka Ken et al.) Sep. 11, 2001, col. 7, line 29 —col. 12 line 8, figures 4A 12–14.

* cited by examiner

*Primary Examiner*—Craig Hallacher

(57) ABSTRACT

A print monitoring approach is provided in which sequences of irregular two-dimensional frames of image information are captured at a resolution sufficiently high to enable details of individual droplets to be identified. The approach may be used to monitor individual droplets deposited on a medium, such as a sheet of paper, by an inkjet printhead. An optical detector having an irregular two-dimensional array of closely spaced sensor elements is mounted for movement with the inkjet printhead or other print assembly. A processor is responsive to the image frames from the optical detector to adjust print quality parameters when the physical characteristics of the imaged droplets are detected as being outside of a preselected range of acceptability. The physical characteristics that are resolved may include gyrational information or different droplet position information. Optical dot gain can also be measured.

28 Claims, 10 Drawing Sheets

DOT SENSING, COLOR SENSING AND MEDIA SENSING BY A PRINTER FOR QUALITY CONTROL

TECHNICAL FIELD

The invention relates generally to monitoring performance of a printing system and more particularly to systems and methods for optically monitoring print performance.

BACKGROUND ART lnkjet printers provide an inexpensive means for depositing print material (e.g., ink) on paper or another medium. A conventional inkjet printer includes an inkjet printhead mounted on a carriage, which moves the printhead over the paper. The printhead has an ink supply and an array of nozzles which project ink droplets in a particular pattern onto the paper. Each nozzle is formed by a nozzle chamber, a firing mechanism, and an orifice, with the firing mechanism being located within the nozzle chamber. During operation, the nozzle chamber receives a volume of ink from the ink supply, so that when the firing mechanism is activated, an ink droplet is fired from the chamber through the orifice onto the paper. In most inkjet devices, the printhead is moved from side-to-side, while a paper-advancement mechanism is used to change the position of the paper relative to the carriage.

In inkjet printers or in any other printer that deposits print material in the form of dots, the size and the placement of the dots are critical to print quality. If dots are missing or are incorrectly sized or placed, visual defects that are detrimental to the print quality may result. Such errors are noticeable as losses in resolution of the features being printed, imperfections in colors of features or areas being printed, and unintended spatial patterns that appear as Nyquist noise, mosaicing, banding, missing content, or just poor print quality in general.

Systems for detecting some of these losses are known. For example, with regard to the imperfections in colors of features or areas being printed, U.S. Pat. No. 6,036,298 to Walker, which is assigned to the assignee of the present invention, describes the use of a sensing system that includes a single monochromatic photodetecting element, such as a photodiode. The photodetecting element is mounted for travel with an inkjet printhead. A blue light emitting diode (LED) illuminates a region that is imaged by the photodetecting element. In one step, a portion of the paper having no ink is sampled by the photodetecting element to generate a bare media signal, while in a second step, the photodetecting element samples a portion of the media having ink to generate an ink signal. A controller compares the difference between the amplitudes of the bare media signal and the ink signal to a set of reference values. The comparisons determine the color of the ink at the second portion of the media. As another feature of the Walker system, test marks may be formed at specific locations on the paper. After the test marks have been formed, the sensing system may be used to verify the presence of the test marks at the desired locations. When a test mark is not found at a desired location, a "No" signal may be generated to adjust the firing parameters of the print operation. As yet another aspect, color balance may be adjusted as a response to determining that a particular color has not been formed.

A second system that utilizes optical sensing within an inkjet printer is described in U.S. Pat. No. 4,328,504 to Weber et al. As in Walker, the Weber et al. sensing system utilizes a single photodetecting element and uses signal comparisons to determine whether print parameters should be adjusted. The photodetecting element is mounted to an inkjet printhead or other printing device. The photodetecting element outputs a continuous signal as it is moved adjacent to the surface of a paper having ink droplets. This output signal is compared to a signal that represents the desired signal. When a difference is detected between the output signal and the desired signal, a correction is initiated. For example, if a pulse that is generated as a result of detecting an ink droplet along the paper has a duration that is different than the duration of the corresponding pulse along the desired signal, it is presumed that the size of the droplet is incorrect and a correction is triggered.

While the prior art systems and methods operate well for their intended purposes, there are limitations regarding the ability to monitor print quality control. The limitations are tolerable for most low demand print operations, such as printing text documents from a word processing program. However, as the complexity of a document to be printed increases, so do the demands that are placed on the print parameters that relate to print quality. For example, user expectations during the printing of a digital photograph or an image from the World Wide Web have reached a level that requires a printer to be operating at or near peak performance. The known approaches to monitoring print operations may not be sufficient in some applications.

What is needed is a print monitoring approach that enables the acquisition of a richness of print-quality related information, so that quality control can be maintained at a high level.

SUMMARY OF THE INVENTION

The invention utilizes a print monitoring approach in which high resolution two-dimensional frames of image information are captured to resolve physical characteristics of individual droplets that have been deposited on a medium, such as a sheet of paper. An optical detector having a two-dimensional array of closely spaced sensor elements is mounted for movement with a print assembly, such as an inkjet printhead, that deposits the droplets on the medium. A processor is responsive to the optical detector to adjust print quality parameters when the physical characteristics or features of the imaged droplets are detected as being outside of a range of acceptability. The physical features that are imaged and used to generate physical characteristic feedback information may include information regarding the gyrational pattern that is formed as a consequence of the droplet striking and settling on the medium. Alternative feedback information includes data related to the centroid of a droplet, data related to the position of peak light absorption by the droplet, and data related to the intersection of two principal diameters.

In the embodiment in which the print assembly is an inkjet printhead, the dots that are formed by droplets on the medium typically have a diameter in the range of 20 $\mu$m to 60 $\mu$m. Imaging optics are selected to provide a high resolution, but there is concern that, given available illumination devices and required response time, the optics will have a diffractive limit (e.g., 35 $\mu$m) that does not quite reach a preferred level. To provide compensation for resolution in a first direction, the adjacent columns of sensor elements within the optical detector may be offset in an orthogonal direction to the movement of the print assembly and of the optical detector relative to the medium. The measure of the column-to-column offset should be less than the measure of the pitch of sensor elements within a column. For example, if there are six columns of sensor elements within the optical detector, the offset may be one-sixth of the pitch of sensor elements within the columns. Any measure of offset that is less than the pitch will aid in providing sufficient resolution in the first direction to detect useful physical characteristics of the individual droplets on the medium. The diffractive limit of resolution of imaging optics may be countered in the second (orthogonal) direction parallel to the relative movement by acquiring image frames at a rate sufficiently high to limit droplet displacement in successive images to a distance similarly less than the pitch of the columns.

The optical detector arrangement may also include at least one source of illumination. The source may be a light emitting diode (LED) that provides illumination at an angle in the approximate range of 20 degrees to 65 degrees relative to the normal of the surface of the medium on which the droplets are deposited. For embodiments in which the "dot gain" is to be measured, a number of LEDs may be mounted and sequentially activated to illuminate the field of view of the optical detector at different angles of incidence, thereby allowing the shift in the position of the droplet centroid to be sensed.

A combination of a cylindrical lens and a prism may be used to direct light from the illumination source to the medium at the desired angle of incidence. The optical detector arrangement also includes optical lens elements. A droplet-imaging optical device is positioned between the medium and the array of sensor elements. The optical device may provide demagnification, but this is not critical. Any of the optics may be diffractive limited.

In operation of the invention, at least one dot is formed on a medium, such as a sheet of paper, by projecting a droplet of print material onto the medium. The two-dimensional array of sensor elements and the high frame rate achieve a sequence of frame image information to provide (with image processing) a sufficient resolution to enable the processor to resolve detailed information regarding the physical characteristics of the dot. For example, gyrational information or different types of droplet position information (e.g., the position of the dot-centroid) may be identified. The information can then be used to determine whether adjustments should be made to the print operation parameters.

The invention may be used to inspect "stealthy" dots. The term "stealthy dot" is defined herein as a dot that is purposely printed using a single nozzle, where the dot is printed in a region of a medium in which no final content is intended or in a region that is intended to be covered over after the specific dot has been inspected. The concept of "stealthy" derives from the fact that the conventional inkjet printers print dots that are so small individually that the isolated dots are virtually undetectable by the unaided human eye. Stealthy dots or other stealthy marks may be used to accurately determine the position of the print assembly (e.g., inkjet printhead) on the medium. For example, stealthy dots may be used to align the print assembly to add print content to designated areas of a medium having previously printed material. This application is particularly suitable for adding content to pre-printed forms. Stealthy dots may also be used to enable detection of the top, bottom or edges of the medium. Thus, printing onto a page can occur with accurate full-bleeds or with accurate margining. If desirable, the correlation of successive images acquired by the optical detector may be used to track and/or verify relative speeds and positions between the optical detector and the medium of interest. Speed and position may be determined in either or both of the directions from top-to-bottom or from side-to-side across a page. By precisely pre-positioning stealthy dots or other stealthy marks on the medium, the navigation of the optical detector (and therefore the print assembly) may be determined without using conventional encoders for carriage and paper-feed position tracking.

DETAILED DESCRIPTION

Figure 1:
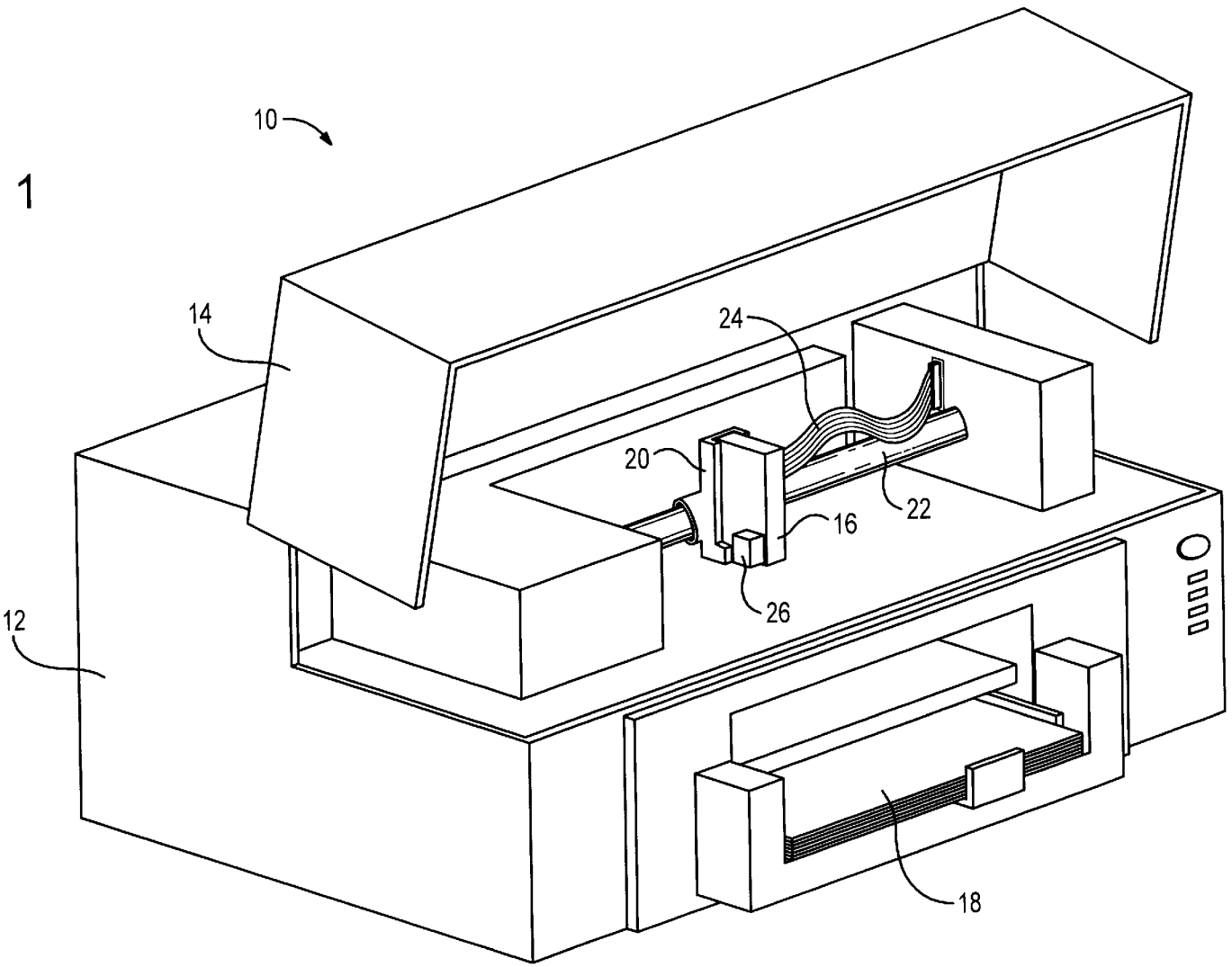
FIG. 1 is a perspective view of a printer that includes droplet-sensing capability in accordance with the invention.

With reference to FIG. 1, a printer 10 that utilizes the droplet-sensing capability of the invention is shown as including a body 12 and a hinged cover 14. The illustrated printer is merely an example of a device in which the invention may be utilized. The printer includes an inkjet printhead 16, which may be a conventional device. As is well known in the art, the inkjet printhead includes a number of nozzles which are individually triggered to project droplets of ink onto a medium, such as a piece of paper. In FIG. 1, the printer includes sheets 18 of paper which are individually moved to the area immediately below the inkjet printhead.

The sheet of paper 18 is stepped principally in one direction along the paper path, while the inkjet printhead moves laterally across the paper in a direction perpendicular to movement of the paper. The inkjet printhead is attached to a carriage 20 that moves back and forth along a carriage transport rail 22. A flexible cable 24 connects the components of the print carriage to a print engine, not shown. The flexible cable includes electrical power lines, clocking lines, control lines and data lines.

In addition to the inkjet printhead 16, the side-to-side movement of the carriage 20 causes displacement of an optical detector arrangement 26. As will be explained more fully below, the optical detector arrangement captures frames of image information with sufficient resolution to allow processing circuitry to distinguish details regarding the physical characteristics of individual droplets formed on a sheet of paper 18. The frames provide image information in two dimensions that are parallel to the plane of the paper below the optical detector 26. Thus, droplet position information and droplet gain can be monitored while a printing operation is occurring. By measuring shift in apparent droplet position under illumination at different angles of incidence, optical dot gain can be measured.

Figure 2:
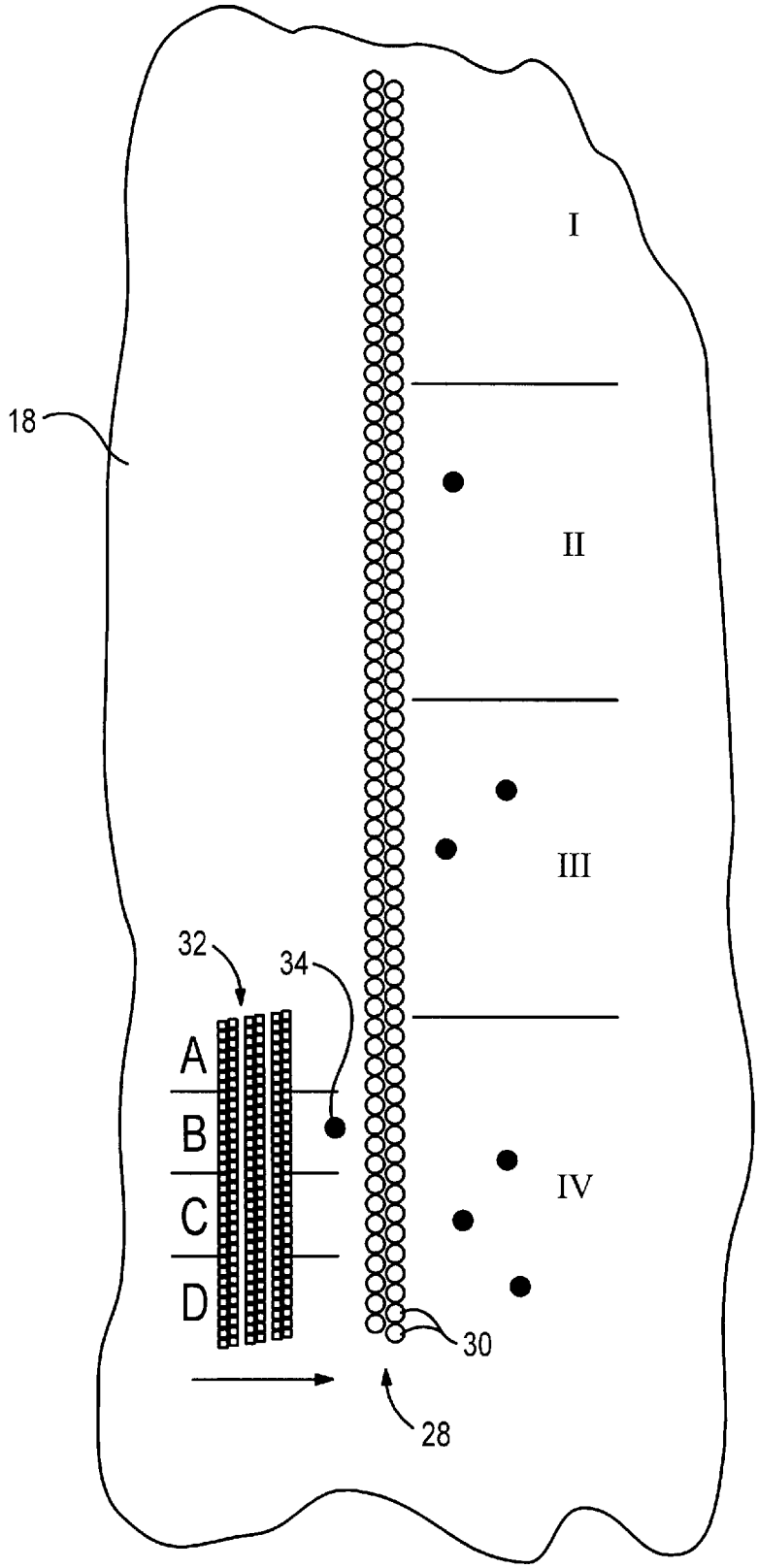
FIG. 2 is a top view of an array of inkjet print nozzles and a two-dimensional array of sensing elements for providing the droplet-sensing capability in the printer of FIG. 1.

FIG. 2 illustrates a top view of an array 28 of inkjet nozzles 30 and an array 32 of sensor elements over a sheet of paper 18. Typically, there are a greater number of inkjet nozzles and a greater number of sensing elements. Inkjet nozzles are well known in the art, while the sensing elements are photodetecting pixels that generate a signal that is responsive to the intensity of light received at the elements. Six columns of sensing elements are shown in the array 32, with the columns being divided into pairs. This leaves space for conductors to be routed out of the array in a direction parallel to the columns. The advantage of leaving space for this routing along the columns is that it reduces the number of conductors that need to be routed in space between vertically adjacent elements (i.e., between two elements within the same column). This enables a high fill-factor, which is defined herein as the ratio of active photosensing size within a "cell" of the array divided by the pitch, where size is measured in the pitch direction along the column length.

The arrays 28 and 32 move across the surface of the paper 18 in the direction indicated by the arrow. The columns in the array 32 of sensing elements are offset in a direction perpendicular to the movement. The advantage of the offset will be described in greater detail when referring to FIG. 4. The main advantage is that it allows an increase of spatial resolution in the direction along the long axes of the columns in the array. For maximizing page throughput, it is desirable to measure dots on the page along the entire height of the sensing array 32 in the fewest passes of the carriage 20 of FIG. 1. The column-to-column offset removes the need to displace the paper vertically in steps as small as the desired vertical resolution in dot imaging. Thus, column-to-column offsets may be used to provide the desired vertical resolution, while the desired horizontal resolution (again as viewed in FIG. 2) may be achieved by providing sub-element displacement in the timing of sensor sampling, as will be described in greater detail below.

FIG. 2 also shows the segmentation of the array 28 of inkjet nozzles 30 into four segments, as indicated by the labels "I," "II," "III" and "IV." This segmentation involves the printing processes that are designed to build up printed content in any given area of the paper 18 by utilizing nozzles from a variety of segments, rather than from a single segment. The segmentation is known in the art. The segmentation is designed to avoid systematic errors that might otherwise result from similar nozzle defects within a given segment. As a consequence of this precautionary measure, paper advancement between each carriage swath is less than the full height of the nozzle columns. It follows that the height of the array 32 of sensing elements does not need to be equal to the height of the nozzle array 28.

With the exception of segment 1, there are dots in each of the four segments. The dots to the right of the nozzles 30 in segment IV are dots which must have been printed by one or more of the top three segments, since the fourth segment has not passed over this area of the paper 18. On the other hand, the dot 34 between the two arrays 28 and 32 may have been printed by a nozzle within any one of the four segments. This dot is about to be imaged by the sensing array 32. After the dot 34 is imaged, the other three dots within the lowermost segment will be imaged.

The columns of the sensing array 32 are also segmented. The reason for this sensing array segmentation has to do with the communication capacity (i.e., bandwidth) between the dot-sensor chip which travels with the print carriage and the dot-analysis processors that may reside within the stationary structure of the printer. Since the print engine has control of where and when printed dots are created and has control of the position of the print carriage, the print engine can command which segment of the sensing array should be used to capture images of any given dot. In this manner, the image data captured for a dot can be limited to data from just one or two segments. Thus, only data from those one or two segments needs to be transmitted from the dot-sensor chip to the data analysis capability. Further details regarding the segmentation of the sensing array will be described below with reference to FIG. 4. For both of the arrays 28 and 32, only some of the segments of columns are shown. Typically, there will be more pixels within the array 32 and nozzles within the array 28. A normal swath height of the nozzle array is approximately 12.7 millimeters. Although it would be desirable from a throughput point of view to have a sensing array 32 capable of spanning the entire height of the nozzle array, a span of approximately 6.35 millimeters (i.e., one-half of the nozzle array height) may be more desirable. This choice of dot-sensing swath height is consistent with the limitations of current imaging and illumination capabilities to enable target signal-to-noise ratios while measuring dots on paper at print speeds of at least approximately 762 millimeters per second. To be able to resolve dots on the order of 20 $\mu$m to 60 $\mu$m in diameter on a medium that can ripple over a depth-of-field of ±0.5 millimeters, it is necessary to both (1) limit the front-working numerical aperture of the imaging optics and (2) efficiently collect and focus illumination light onto the high aspect ratio target areas demanded by the geometry of the sensing array. Optionally, if a sensing array were desired that would span more than the 6.35 millimeters, multiple 6.35 millimeter modules could be lined up end-to-end or with some offset to allow some overlap of the respective fields of view of the modules on the paper.

Figure 3:
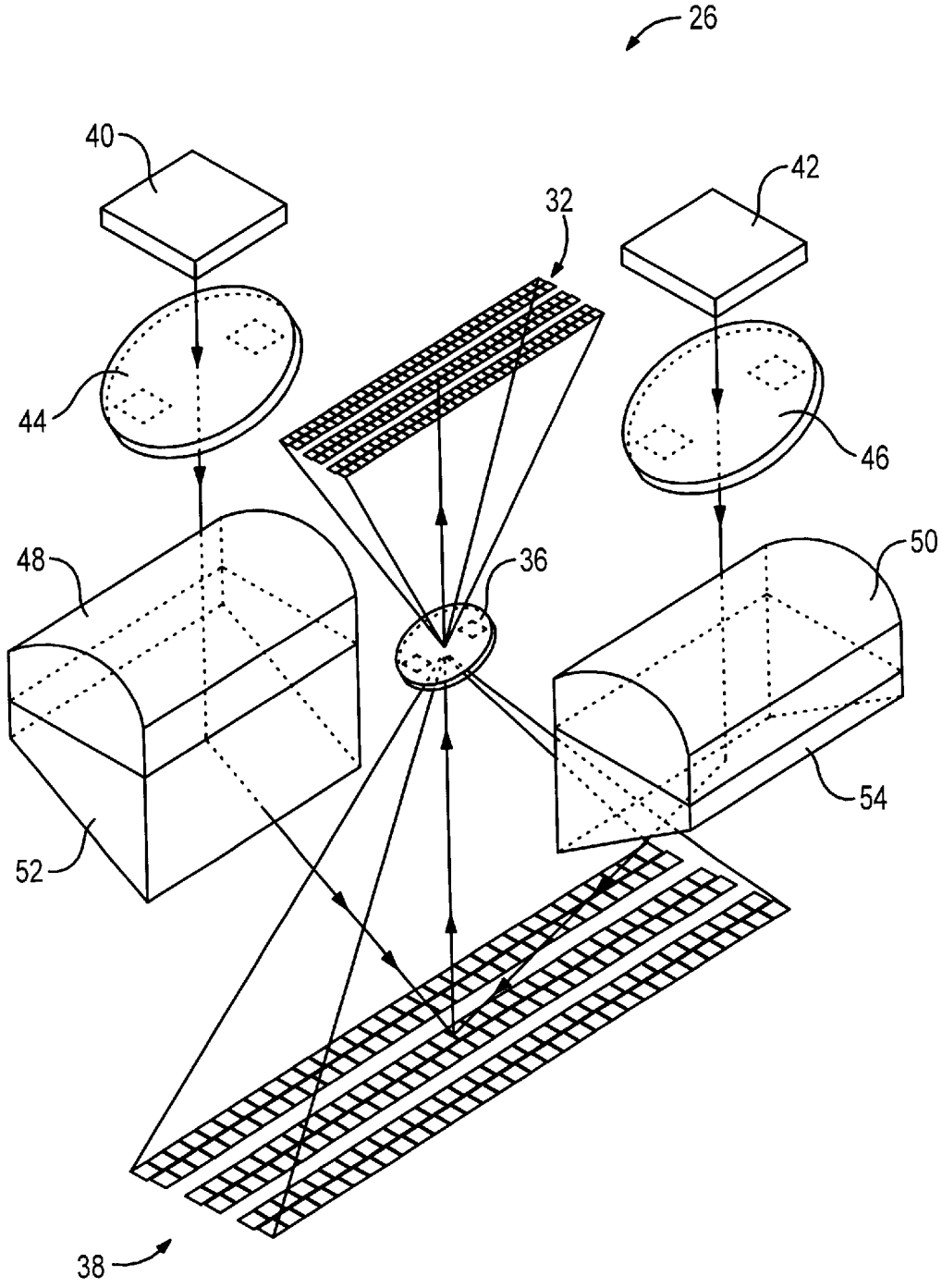
FIG. 3 is a perspective view of the elements of the optical detector arrangement of FIG. 1.
Figure 4:
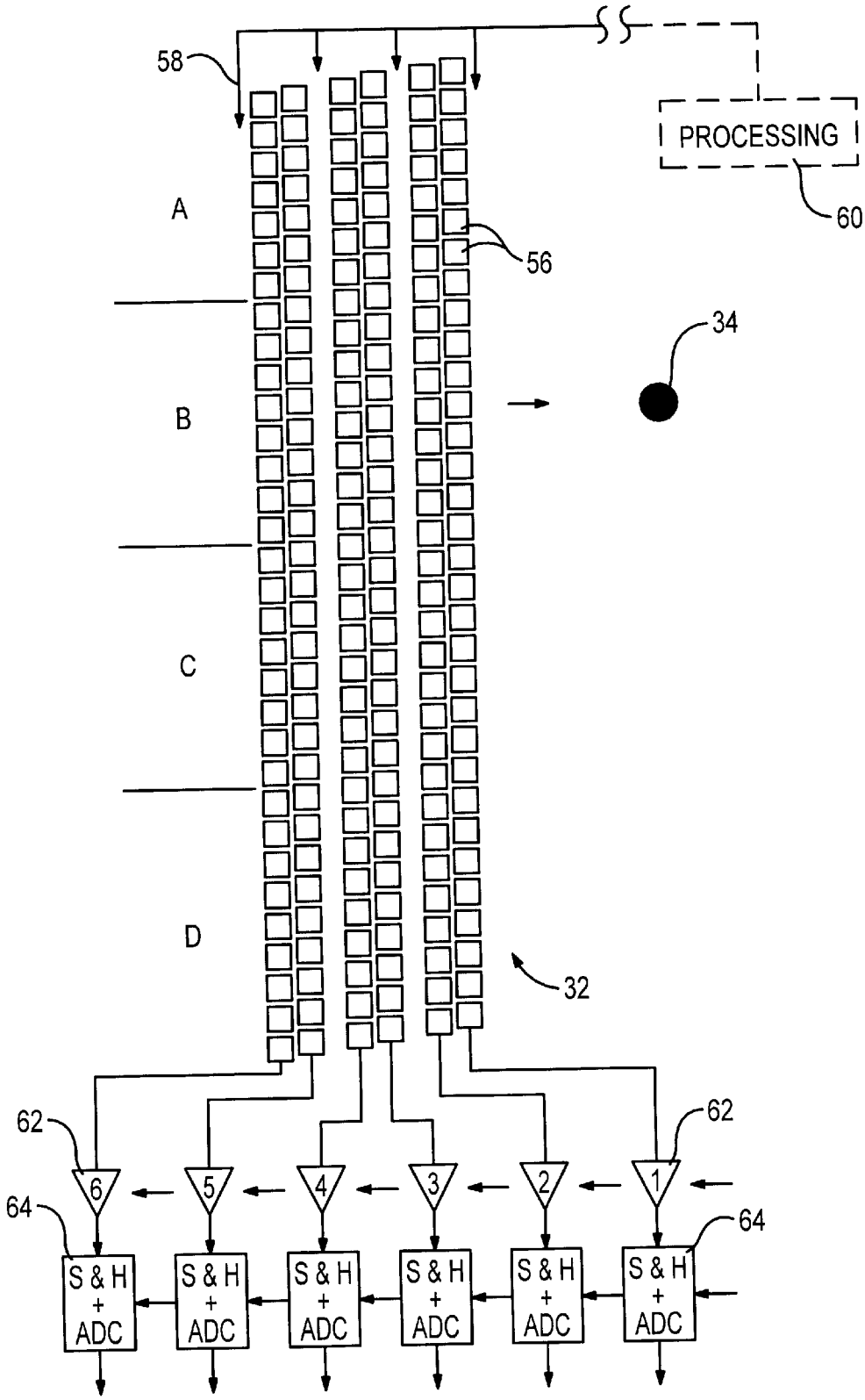
FIG. 4 is a top view of the array of sensing elements of FIG. 3, with selected electronic components for capturing frames of image information.

As shown in FIGS. 2, 3 and 4, the columns of inkjet nozzles 30 within the array 28 and the columns of sensing elements within the array 32 are offset relative to each other. Regarding the inkjet nozzles, the nozzles in any one column are positioned with a pitch of approximately 84.67 $\mu$m. The offset of the second column relative to the first column is approximately one-half of the pitch distance (i.e., approximately 42.33 $\mu$m). This offset combination of nozzle columns provides a nozzle every 42.33 $\mu$m for a final dot pitch of 600 dpi (dots per inch) (i.e., 15,240 dots per millimeter). Optionally, the nozzles in the columns may be tilted from a common vertical axis or may be otherwise varied from the arrangement shown in FIG. 2, but these details are not pertinent to the invention.

The various components of the optical detector arrangement 26 of FIG. 1 are best shown in FIG. 3. The array 32 of sensing elements is shown as being positioned above a dot-imaging optical element 36 that aids in defining the field of view 38 of the array. The field of view is represented as an array on a top surface of a medium, such as a sheet of paper. A blocking filter can be added to the imaging optics to prevent light of undesired wavelengths of background illumination from reaching the array 32. Some demagnification (e.g., approximately one-half) may be used to keep the size and the cost of the sensor chip relatively low, although this can increase the costs of chip alignment about or around the optical axis of the element 36. Some depth-of-field is required about the ideal position of the plane of the medium in order to accommodate distortions of the medium as caused by wet ink and other factors. A depth of field of approximately ±0.5 millimeters may be provided. Due to this depth of field requirement, only a small numerical aperture is permitted with which to collect light scattered from the medium and ink droplets. Fortunately, this small front-side numerical aperture permits some demagnification without imposing any severe requirements on the optical design of the imaging lens.

In order to achieve the desired resolution at typical carriage scan speeds, the array 32 of sensing elements is likely to require illumination of the target area 38 with high irradiance levels. The precise level depends upon the gain available at amplifiers that are mounted with the array, as will be described with reference to FIG. 4. FIG. 3 also shows an example of how this illumination can be accomplished in a small package, enabling low cost assembly techniques. Although only two light sources 40 and 42 are shown, one for each of two colors of illumination, third and fourth light sources can be added. These additional illumination subassemblies can be set to illuminate the medium with either smaller or larger angles of incidence, but all in the same plane of incidence as light from the illustrated two light sources.

Each of the illumination subassemblies of FIG. 3 includes a light source 40 or 42, a collection lens 44 or 46, a cylindrical lens 48 or 50, and a prism 52 or 54. The function of the cylindrical lens for each of the subassemblies is to transform the usual circular beam cross section into an ellipse of high aspect ratio to better match the aspect ratio of the target area 38. The prism is used to deviate the beam to the desired angle of incidence onto the medium. The angle of incidence may be 45 degrees, but other angles between approximately 10 degrees and 75 degrees may provide benefits in some applications. However, the disadvantages of the larger angles of incidence include the greater difficulty in providing alignment of the illuminations and include reductions of the irradiance onto the target area 38 and collections of signal light. Disadvantages of the smaller angles of incidence involve the mechanical interference constraints imposed by miniaturization issues and by potential direct-reflection effects arising from localized tilting of the medium surface from factors such as area deformation by wet or dry ink. It is beneficial that the illumination optics be designed to provide a depth of field for the illumination that is slightly deeper than the depth of field of the imaging optics. The design should also provide sufficient margin of extra illumination beyond the perimeter of the target area, so as to accommodate alignment errors between the illumination and the imaging subassemblies. It is also beneficial that the illumination of the target area 38 be as uniform as practicable.

The light sources 40 and 42 may be LEDs. Although the LEDs are illustrated as being rectangular chips, they may also include reflector cups, as is known in the art of LED design. The collection lenses 44 and 46 for each LED may be an integral part of that LED. Additional illumination optics may be included, such as apertures, baffles and devices to block or absorb stray light from reaching the sensing array 32 by more direct routes than via the medium in the target area 38. If one or more sources of white light are used, then red, green and blue color filters may be included for the sensing area, but in that case, additional columns of sensing elements may be necessary.

As an alternative to using the prisms 52 and 54, the illumination subsystems may be tilted at the desired angle of incidence relative to the target area 38. However, this may require a loss of a degree of miniaturization. As another alternative to the embodiment of FIG. 3, the collection lenses 44 and 46, the cylindrical lenses 48 and 50 and the prisms 52 and 54 may be ordered in a different sequence or replaced in part or whole with a diffractive optical device. Computer generated diffractive optics are known which can transform the light from an LED into a rectangular target area. The optics may also deviate the beam such that the LED can be mounted on the same substrate as the sensing array 32 and at the same time direct the illumination onto the medium with the desired angle or angles of incidence.

Referring now to FIG. 4, the six columns of the sensing array 32 are better illustrated. The photosensing elements 56 are divided into segments "A," "B," "C" and "D." Each segment includes the same number of elements, or pixels. The elements may be formed on the same substrate as supporting electronics, some of which are shown in FIG. 4. The illustration may be considered to be a plan view looking down on a medium on which a printed dot 34 has been formed, with the array 32 being moved toward the dot. If 1:1 image magnification is being used, then the array can also represent the field of view mapped on the medium. As indicated by the arrow, the motion of the array 32 relative to the dot 34 will at some time cause the image of the dot to be generated by sensing elements 56 within segment "B."

The number of segments and the number of elements per segment are understated to make the illustration of individual cells possible. A more practical embodiment would be one in which there are 256 sensing elements along each column in the array 32. A field of view of a single sensing element 56 is approximately 25 $\mu$m. Thus, the size of the sensing elements depends upon the magnification. The 25 $\mu$m dimension is close to or slightly smaller than the approximately 35 $\mu$m diffractive limit of resolution of the imaging optics designed for a depth of field of ±0.5 millimeters. The dot diameters for presently available inkjet pens are on the order of 20 $\mu$m to 60 $\mu$m in diameter. The size of these dots, convolved with the point-spread-function of the resolution-limited imaging lens (and extended in the direction of travel by motion-blur during frame integration periods), span one to a few cells across the array 32. Thus, to measure dot diameters and centration positions, a resolution is required that is better than the resolving power of the imaging lens. This limitation is partially countered in the direction perpendicular to the relative movement by the above-identified offset of adjacent columns. The column-to-column offset is a fraction of the pitch of elements within a column. The limitation is partially countered in the direction parallel to the relative motion by acquiring image frames at a rate that is sufficiently high to ensure that dot displacement during the period between successive captures is less than the element pitch. Preferably, the two fractions are equal. In the embodiment of FIG. 4, the column-to-column offsets and the dot travel between frames are approximately one-sixth of the pitch of sensing elements within a column. In addition, it is possible to mathematically remove some of the effects of a dot image being convolved with the point-spread-function of the imaging lens by a deconvolution. This is best accomplished when the dot image is larger than the point-spread-function. Moreover, it is possible to remove some of the effects of image blur, since the carriage speed is known.

A number of conductors 58 carry supply voltages, control signals and addresses from an off-chip processing capability 60 to the appropriate locations on the sensor chip. The chip architecture may include a number of sets of signal handling arrangements that is equal to the number of columns in the array 32. Each arrangement is shown as including an amplifier 62 and a device 64 that provides both signal-and-hold (S&H) and an analog-to-digital conversion (ADC). While not shown in FIG. 4, the outputs of the devices 64 are connected to the off-chip processing capability 60. The amplifiers 62 provide gain and offset controls. The inputs to the amplifiers are multiplexed signals from the sensing elements of the corresponding column. The operations of the devices 64 are well known in the art. In general, chip architectures other than the one shown in FIG. 4 may be substituted.

Figure 5:
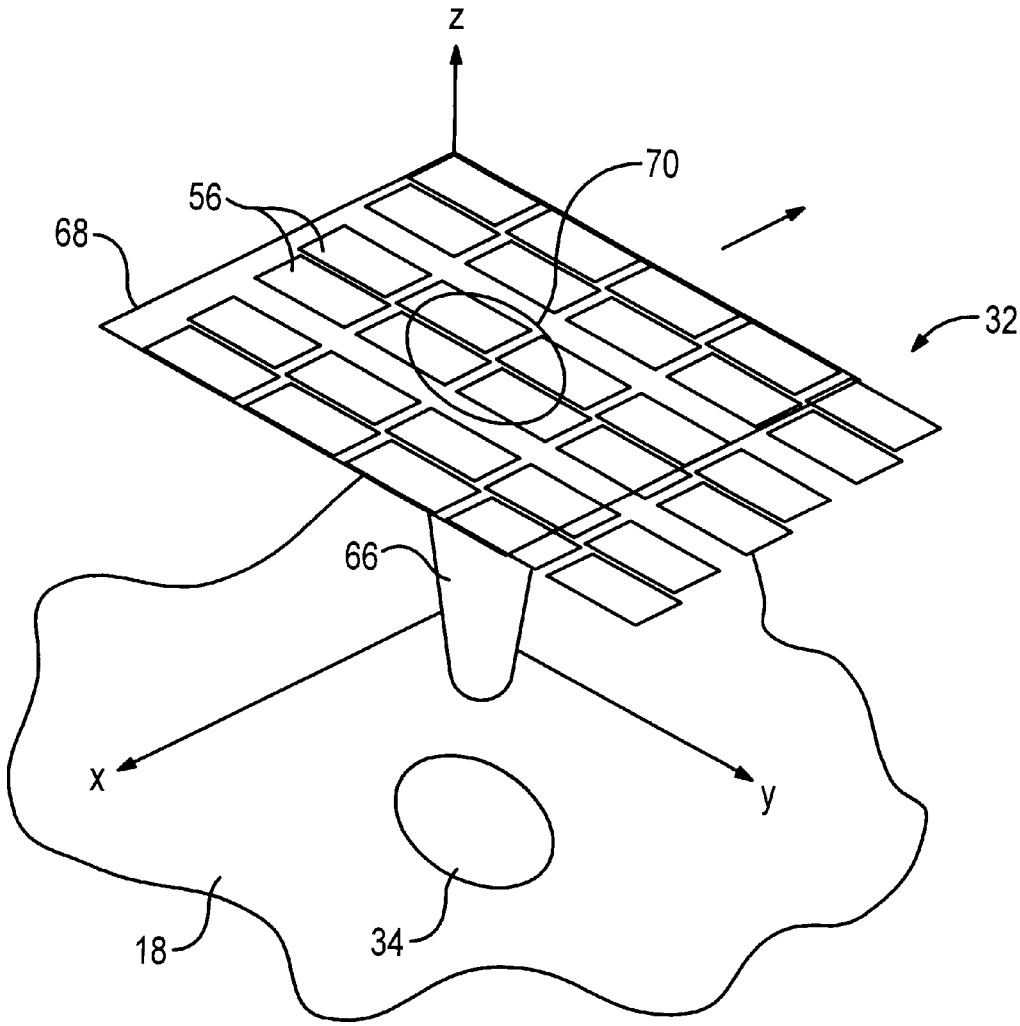
FIG. 5 is a perspective schematic illustration of imaging a droplet on a medium using an optical detector in accordance with the invention.

FIG. 5 shows one-to-one imaging of the dot 34 on the medium 18 by the sensing array 32. The dot is stationary along the illustrated x,y-coordinate system. The light intensities in the image plane of the imaging lens (not shown) are represented by the height of the imaginary membrane that is illustrated as an inverted sombrero 66 with a head size of the dot image 70 and a rectangular brim 68. The rectangular shape of the brim 68 is only roughly suggestive of the portion of the image field that overlaps some of the sensing elements at the illustrated moment. As time elapses beyond this moment, the brim and the array move in the direction indicated by the arrow, while the deep portion of the sombrero configuration remains stationary above the dot 34 and disappears as the array 32 moves away.

Figure 6:
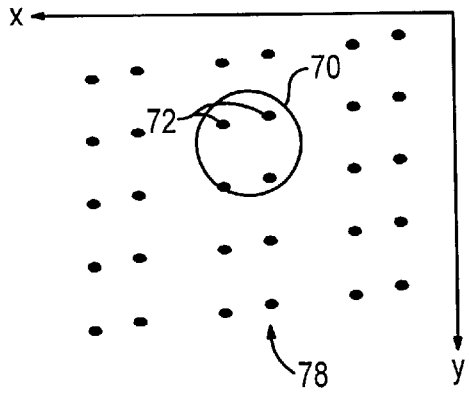
FIG. 6 is a top view of the relative positions of centers of sensing elements and a droplet image in a single image frame.
Figure 7:
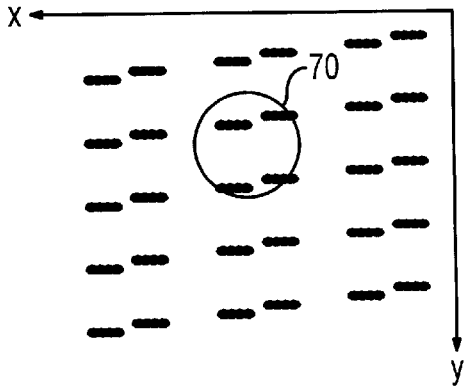
FIG. 7 is a top view of the relative positions of the element centers and droplet image of FIG. 6 during four successive image frames.

Referring now to FIG. 6, the image 70 of the dot is formed on a number of the sensing elements in a single sampling frame. The centers 72 of the sensing elements are represented by darkened ovals. The longer diameter of the ovals is usually parallel to the direction of the motion and caused by the motion blur during the frame's integration interval. These darkened ovals also represent the sampling density within a portion of a single image frame. The image 70 of the ink dot will determine the outputs of the corresponding sensing elements in the image frame "i."In FIG. 7, a succession of four sampling frames is superimposed. That is, in addition to the image frame "i"of FIG. 6, sensing element centers are shown for the three subsequent image frames "i+1," "i+2" and "i+3." From FIG. 7, it can be seen how the succession of image acquisitions from the sensing array can be used to increase the sampling density and coverage for the intensities of light in the image 70 of the ink dot.

Figure 8:
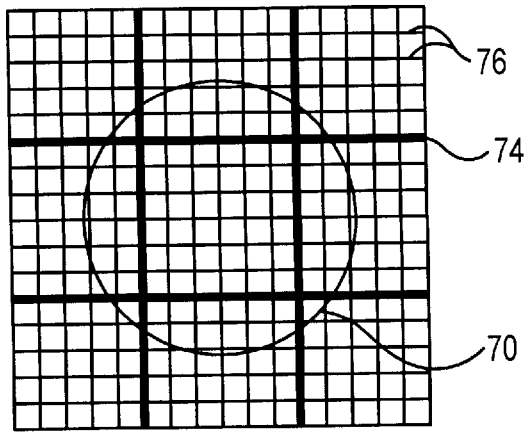
FIG. 8 is a representation of the sampling rate and sensing element frequency that provide desired horizontal and vertical resolutions during operation of the sensing array of FIGS. 2–5.

FIG. 8 illustrates a grid of major thickness lines 74 and a grid of minor thickness lines 76. The horizontal major thickness lines 74 represent the approximate paths of the centers of the sensing elements from the fourth column 78 from the left in the array shown in FIG. 6. The horizontal minor grid lines represent the paths of sensing elements in all other columns. Thus, the vertical pitch of the major thickness lines 74 is the same as the vertical pitch of a single column 78 in the sensing array, while the vertical pitch of the minor thickness lines is the vertical sampling frequency of the entire array of six columns. FIG. 8 again shows that the column-to-column offset of sensing elements increases the vertical sampling frequency relative to a pitch of a single column.

The vertical major thickness lines have no particular importance, but the vertical minor thickness lines have a pitch that represents the rate of image frame capture in an attempt to match the horizontal resolution to the vertical resolution. The dot image 70 is also shown in FIG. 8, so that it can be demonstrated that the sampling is sufficient to allow the system to distinguish droplet details when the image frames are merged.

Figure 9:
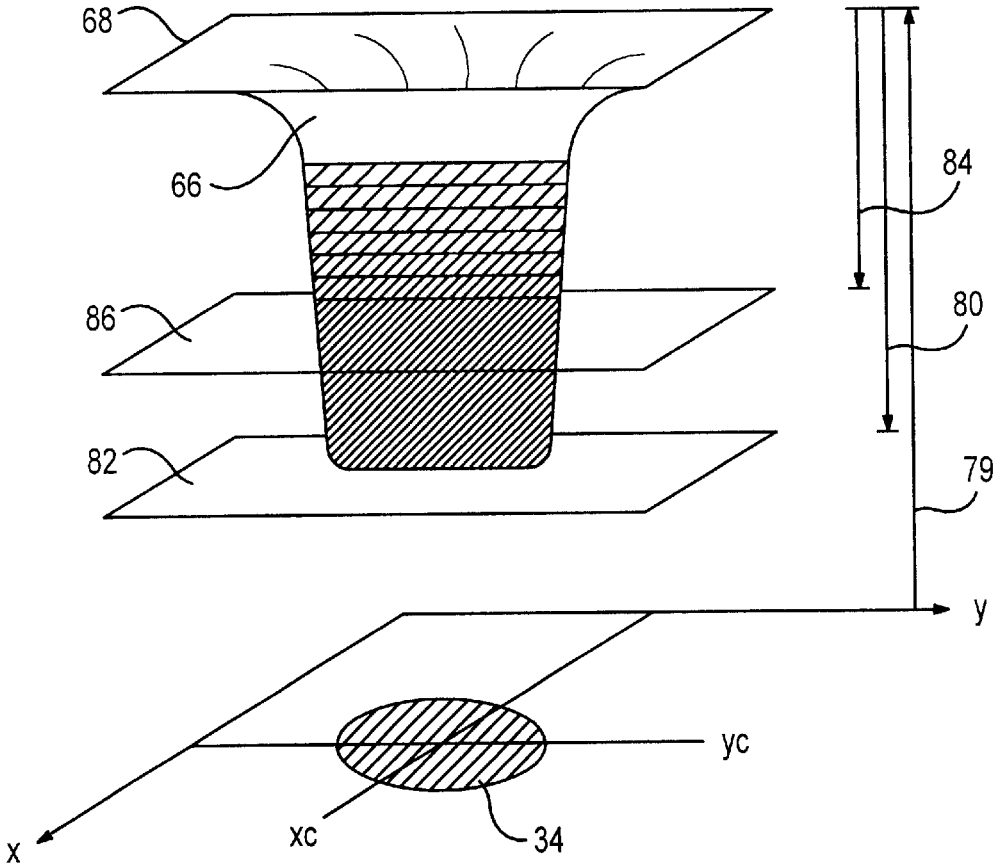
FIG. 9 is a schematic illustration of the droplet sensing of FIG. 5, with droplet density measurements being represented by cross-hatching.

FIG. 9 illustrates computational aspects of transforming dotimage raw pixel data (from combined image frames) into dot size and position metrics. One skilled in the art of algorithms for calculating physical measurements from sensor data will readily appreciate that a variety of computational methods are available. These methods range from ad hoc numerical routines to formally fitting a polynomial or other function to the data, followed by estimating size and position from the resulting function. Ad hoc methods and simple geometric estimates have the advantage of computational simplicity, but curve fitting offers higher accuracy and precision. Which algorithms are preferred depends upon system tradeoffs that are particular to the processing power available at the dot sensing chip and at the remainder of the printer in which the chip resides.

One sophisticated possibility by which to detect and measure dot position is to measure the displacement of the dot from its expected position. This can be done by means of a correlation process between the captured image and a pseudo image developed around a model of how an "ideal dot" should look were it centered in the expected location. As one example, it can be presumed that the dot in a captured image is slightly off-center of the field of view from where it should have been and that the system has a pseudo image of the expected "ideal dot" centered in the field of view (from earlier design data or from recent dot sensing data). Then, dot centration error can be calculated from nine root-sum-of-squared-differences correlation values between the pseudo image and nine images created by displacing the center of the captured image to nine respective points on a grid (the four linear displacements, the four diagonal displacements, and the ninth displacement being a null displacement) about center. For computational simplicity, the displacements are taken in sizes matching the pitch of the sensing array. In a next step, the nine results are fit to a three-dimensional polynomial function. Thereafter, finding the negative of the displacement vector to the maximum value locates the centration error in the captured dot image.

In a simpler manner, correlations between captured images and members of a set of model images can be performed to find which member is the one which most closely resembles the captured image. This technique can be applied to the identification of dot size, as well as dot shape. One advantage of this matching is that it circumvents the need to choose artificial and arbitrary, but precise, definitions of size and shape.

FIG. 9 illustrates image irradiances or intensities on the sensing elements as having the configuration of an inverted sombrero 66 having a rectangular brim 68. The sombrero is inverted, because the medium is brighter than the dot 34 formed by the ink droplet. The representation of intensities varies from no hatching (white) in regions that represent unprinted medium surface to high density hatching in regions of the medium surface that coincide with the ink dye in the printed dot 34. Dot metrics of size, shape and position can be defined and characterized in a variety of ways, depending upon definitions used, desired accuracy, desired precision, and ease of computation. For example, dot position can be defined as the position of the centroid of a specifically defined dot area, wherein the dot area is defined by a perimeter that is the loci of points halfway up the sombrero. Of course, the choice of "halfway" is an arbitrary definition and might conveniently be changed to some other fraction, such as one-tenth or nine-tenths. Alternatively, dot position may be defined by the intersection of vertical planes (xc=constant, yc=constant) that are parallel to the coordinate axes of carriage and media travel (x,y axes) and that are found to best bisect the sombrero configuration into equal volume halves across these planes. Dot shape can also be defined as the radii of gyration along the x and y directions of the dot area used in defining the position of the dot centroid taken about that centroid. Dot size can be characterized as the mean diameter (or both diameters parallel to the x and y axes) of the dot area used in the selected definition of dot position.

In FIG. 9, the line 79 from the brim 68 to the surface of the medium represents the magnitude of media signal, the line 80 from the brim to plane 82 represents the "full height" or darkest part of the dot density signals, while the line 84 from the brim to the plane 86 represents the "half height" of dot density signals.

Using the invention, physical or optical dot gain can also be determined with the techniques described above. "Optical dot gain" relates to measurements that are dependent not only upon the physical makeup of a dot, but also upon illumination incidence angles (since they determine dot shadows) and upon the medium (since such factors as medium transparency will determine the intensity of dot shadows). The apparent dot size is first measured with directed illumination of fairly low incidence angle. Next, the shift of the position of the dot centroid under a higher incidence of directed illumination is measured. This shift, together with media type, can be translated using a calibration table or mathematical function into an estimate of the smaller, physical dot size. The translation step could simply translate apparent dot size and measured centroid shift into the physical dot size. Alternatively, the translation step could translate measured apparent dot size, centroid shift, and sensed media type in a better estimate of physical dot size. A lookup table that includes these factors could be searched in an execution of the translation step. The ratio of the apparent dot size to the physical dot size is a measure of optical dot gain. Dividing the physical dot size by an assumed ideal dot size can produce a measure of physical dot gain. Returning to FIG. 3, if the system includes more than one light source 40 or 42 (and preferably more than two light sources), dot gain can be measured by sensing shifts in the position of the dot centroid when the dot is illuminated sequentially by the different light sources at different angles of incidence. Dot gains and other metric information may be ascertained and then used to provide feedback for adjustments of print operations. As a droplet strikes a medium and is absorbed, a dot pattern will be formed. By using the imaging arrangement, the radii of gyration parallel to long and short axes of either the medium or the printing coordinates may be identified. Alternatively, the radii of gyration about principle axes of the dot may be calculated for feedback purposes. Yet another physical characteristic which may be identified is the position of peak absorption within the area of the dot.

The use of different colored light sources individually in sequence or in combination also enables close monitoring of the probable color appearance of the final printed document. Printed color can be characterized with micro-densitometry signal processing. By measuring the physical size and centration of individual dots, dot populations and area fill factors can be deduced over a field larger than that of a single image frame of the sensing array. The resulting collective view from many image frames allows processing circuitry to deduce resulting optical print densities.

Media discrimination may also be implemented. That is, the invention may be adapted to distinguish media on which the dots are formed. Output signals from the sensing array respond to the different reflectivities of the possible media. An additional light source can be used to shine light through the medium from the back side to yield a signal that easily sorts transparencies from relatively opaque media. Furthermore, the resolution of the dot sensor is sufficient to distinguish texture within the images of medium surface. Surface textual differences can be sometimes enhanced by using illumination with a high or grazing angle of incidence. Alternatively, or in combination with other media attributes, media can be detected or discriminated by analyzing the pattern into which the ink in a dot is distributed on or within the media. Using cluster-weighted modeling, all of this data or subsets of the data can be algorithmically used to discriminate media into classes or types. Knowing the type of media on which dots are to be printed enables the user to be notified if the wrong media is being used.

As previously noted, the sensing array may be tilted relative to the medium. Array tilting is described in greater detail in U.S. Pat. No. 6,188,058 to Tullis, which is assigned to the assignee of the present invention. Adding columns of sensing elements to the tilted array allows the system to either (1) extend the depth of field without deceasing the front numerical aperture of the image optics or (2) increase the signal-to-noise ratio by opening up the front numerical aperture of the imaging optics. The array should be tilted around an axis parallel to the columns. In this manner, the group of columns that independently yields the smallest dot size results is used, while the results from the other columns are disregarded.

FIGS. 10–18 show a sequence of steps in which carriage-mounted members are moved laterally while a medium 88 (e.g., a sheet of paper) is moved in a perpendicular direction, as indicated by arrow 90. In this embodiment, the carriage-mounted members include an optical detector 92, a color inkjet cartridge 94, and a second inkjet cartridge 96 that provides black ink for print operations that do not require color. In this embodiment, the optical detector 92 is on the right-hand side of the cartridges, rather than on the opposite side. Also in this example of an application, the optical sensor array is approximately 25 percent of the length of the inkjet nozzle columns, but this is not critical. In the sequence of steps, the segments of nozzles within one or both of the cartridges are sequentially positioned and activated to contribute to the printing of dots within a single dot-sensing swath along the lead edge of the medium. This allows the optical detector to subsequently scan the dots in a single transit across the medium and to ascertain the performance of each segment.

Figure 10:
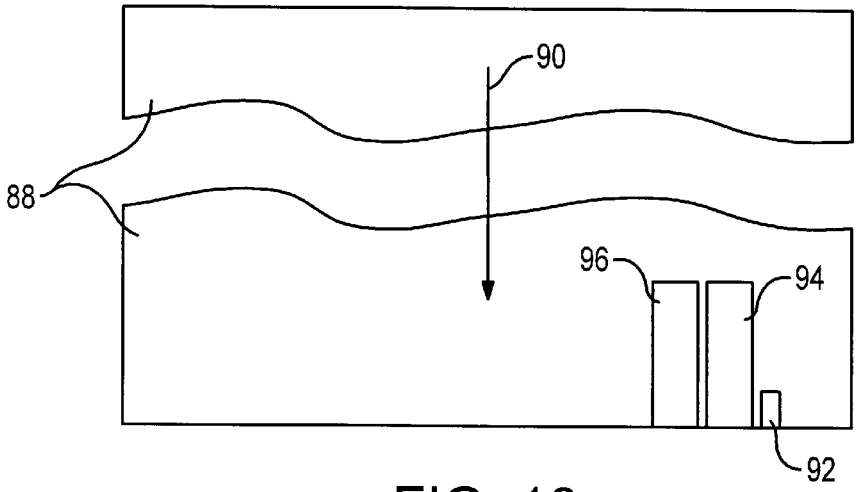
FIGS. 10–18 are representations of a sequence of steps that may be followed in utilizing the invention.

In FIG. 10, the two cartridges 94 and 96 and the optical detector 92 are positioned over the medium 88. As will be explained more fully below, this position allows the optical detector to be used as a means for identifying the precise location of the edge of the medium. When all of the sensors within the detector array are positioned to view the medium, or when a selected portion of the sensors is positioned to view the medium, the degree of paper advancement along the paper path 90 may be identified. The position of the optical detector also allows the detector to be used to identify the medium. The optical characteristics of a sheet of plain paper are distinguishable from optical characteristics of other media, such as transparencies. The print parameters may be adjusted on the basis of the type of medium on which the ink is to be deposited.

Figure 11:
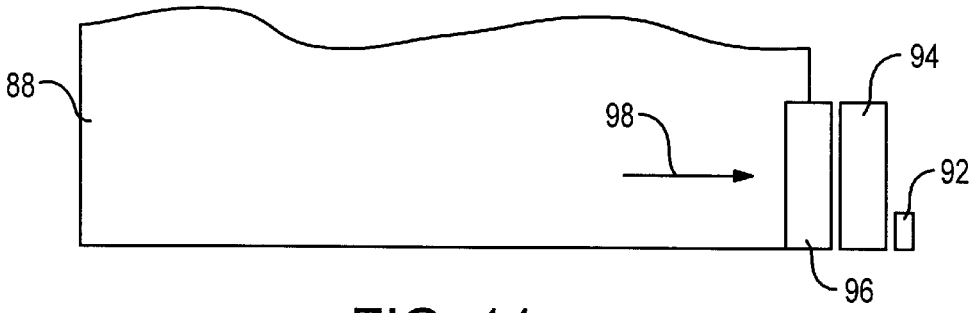
Figure 12:
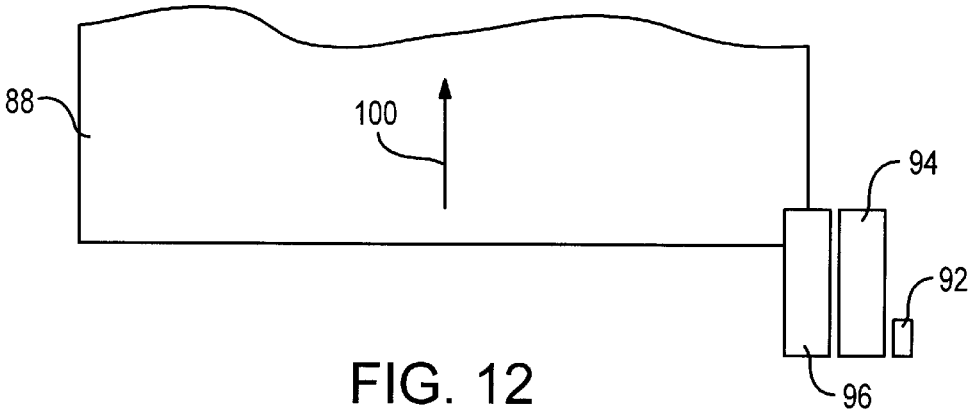

In FIG. 11, the cartridges 94 and 96 and the optical detector 92 are returned to a side of the medium 88, as indicated by arrow 98. The medium may then be retreated along the paper path, so that the relative positions of the medium 88 and the carriage-mounted members are as shown in FIG. 12. The displacement of the medium 88 is indicated by the arrow 100. In the position of FIG. 12, the first segment of inkjet nozzles of each of the cartridges 94 and 96 will be in a position to print dots along the leading edge of the medium 88. Referring briefly to FIG. 2, the first segment of the inkjet nozzles 30 is indicated by the label "I."

Figure 13:
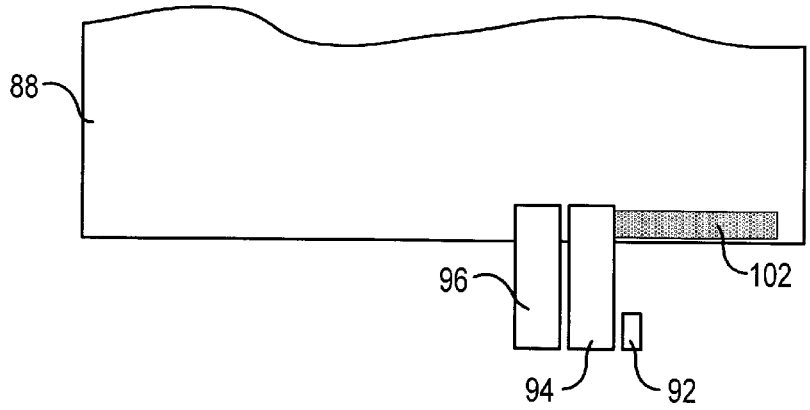
Figure 14:
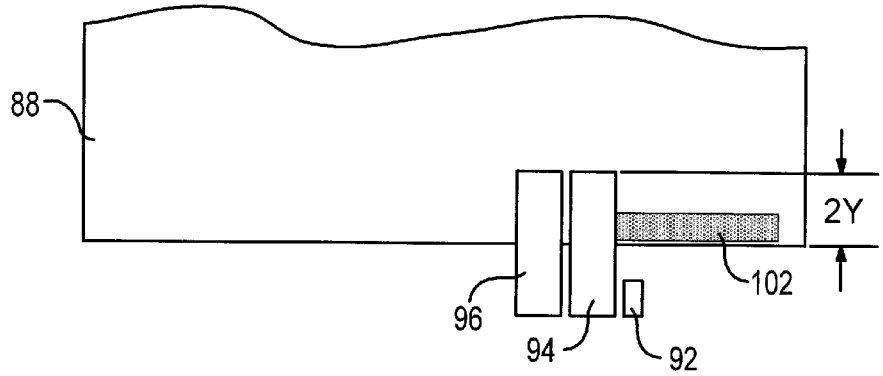
Figure 15:
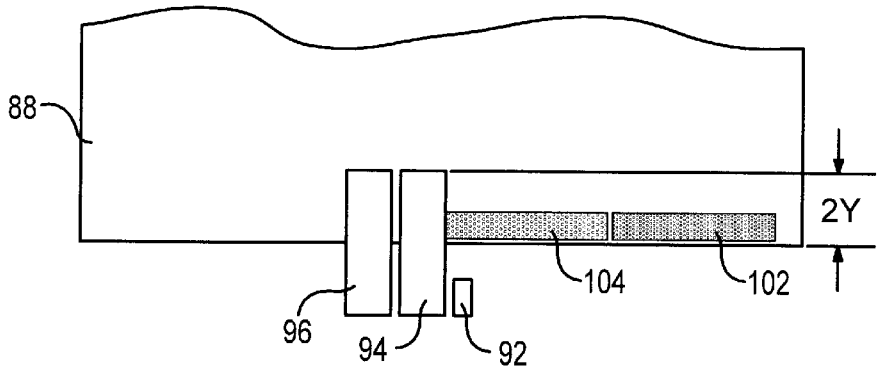

Referring now to FIG. 13, the first segment of inkjet nozzles within one or both of the cartridges 94 and 96 is used to print dots along a first portion 102 of the dot sensing swath along the leading edge of the medium 88. Preferably, the dots are stealthy dots, so that they cannot be detected by the unaided human eye. Other stealthy marks may be substituted. After this first portion has been printed upon, the paper is advanced to the position shown in FIG. 14. In this position, the second segment of inkjet nozzles is positioned to form dots along the dot sensing swath aligned with the first portion 102. If the length of each segment of nozzles is equal to Y, the cartridges will extend onto the medium 88 by a distance of 2Y, as indicated in FIG. 14. The cartridges can then be moved laterally to provide dots within a second portion 104 represented in FIG. 15.

Figure 16:
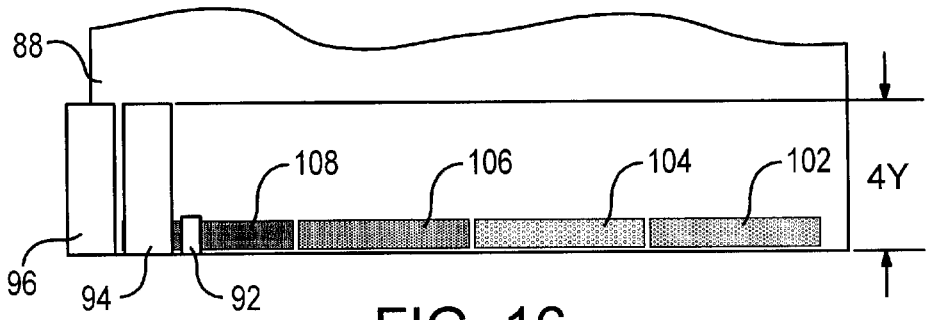
Figure 17:
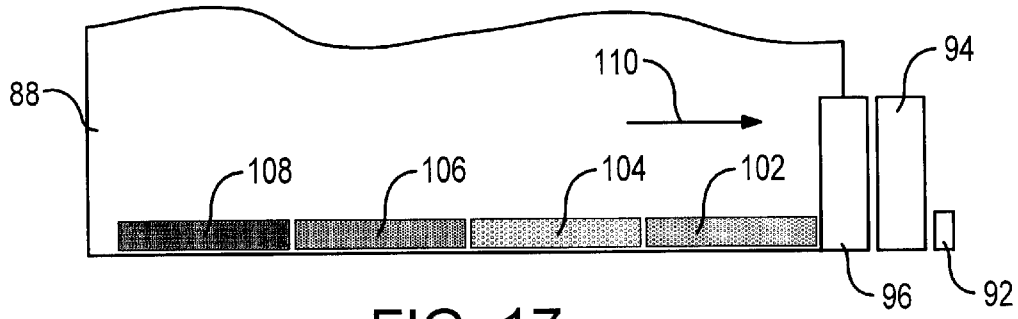
Figure 18:
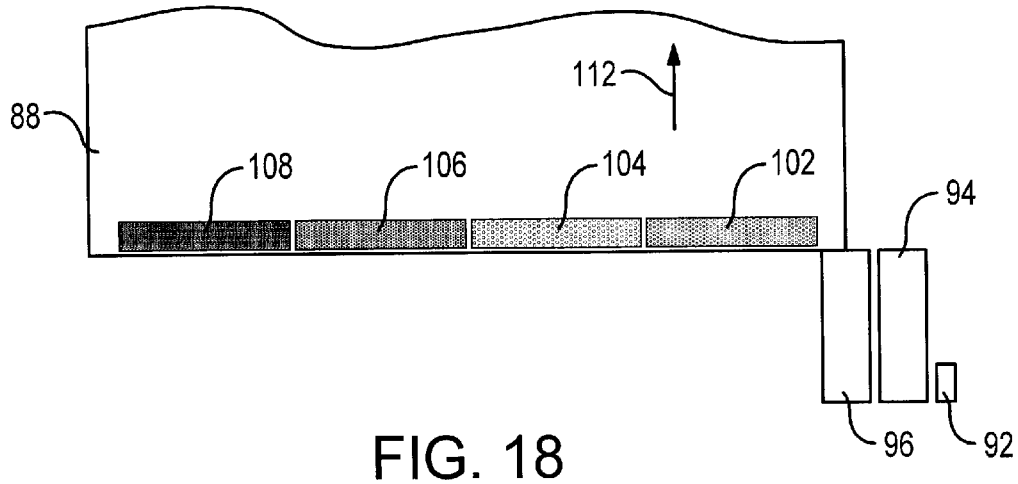

After the cartridges 94 and 96 form the pattern within the second portion 104 of the dot sensing swath across the lead edge of the medium 88, the medium can again be advanced in order to print within a third portion 106 (of FIG. 16) of the swath. In this position, the cartridges 94 and 96 will extend onto the medium by a distance of approximately 3Y. With another such advancement, a fourth portion 108 of the swath may receive ink from the fourth segments of nozzles of the cartridges. In FIG. 16, all four portions 102, 104, 106 and 108 are shown as having print matter, since the cartridges 94 and 96 have been moved to a position in which they extend onto the medium 88 by a distance of 4Y. In this position, the optical detector 92 is aligned with the swath. As the cartridges 94 and 96 and the optical detector 92 are returned (indicated by arrow 110 in FIG. 17), information from each of the portions is read by the optical detector 92. Consequently, the performance of each of the four segments of the inkjet nozzles within the cartridges can be ascertained. If a cartridge has more than four segments, the dot sensing swath can be divided into more portions or multiple segments can be activated simultaneously. Finally, in FIG. 18, the paper is retreated, as indicated by arrow 112, until the carriage-mounted members are in a start print position relative to the medium 88. Alternatively, the printing process may be initiated from the relative positioning shown in FIG. 17.

As noted with regard to FIG. 10, the invention may be used to accomplish medium edge detection. While a printer carriage remains stationary, the leading edge of the medium 88 or the bottom edge of the medium can be transported through the field-of-view of the optical detector 92, so that the edge is detected using the appropriate algorithm. The light intensities detected by the sensors within the array can be sampled to distinguish strong signals where there is unprinted media and weaker signals where there is only a dark background from the structural surface serving as the support surface of the medium beneath the path of the optical detector 92. The straight boundary between the sensors which receive the strong light intensities and those which receive the weaker light intensities can be detected and related with the edge or edges of the paper. Knowledge of the orientation of the top edge of the paper can then be used to either reorient the paper or at least adjust the printing process to align the print to the known direction of the edge.

As the optical detector 92 of FIG. 10 is scanned across the width of the medium 88, points can be readily recognized algorithmically as points in which the signal intensities abruptly change from strong over the medium to weaker over the supporting surface of the medium. This readily enables detection of the positions and orientations of the sides of the medium.

The arrangement may also be used to track media navigation by correlation of surface texture. The optical detector 92 of FIG. 10 is able to build up an image of a portion of the medium 88, either before or after printing. Paper fibers or other physical features of the medium may be used as a means for determining navigation. This capability, along with medium edge detection, can be employed to control the relative positioning and motion of the medium and/or the carriage on which the cartridges 94 and 96 are mounted. This could result in the elimination of the need for costly separate encoders which are utilized for both medium transport and carriage transport purposes.

The ability to precisely identify the location of inkjet cartridges 94 and 96 relative to a medium 88 allows a user to efficiently align a cartridge with an area of a pre-printed form in which new printed content is to be deposited. In one application, edge detection is used to provide the knowledge of a relative positioning. As an alternative application, the optical detector 92 senses locations of stealthy dots that are precisely located relative to the areas in which newly printed content is to be deposited. Other means for optically detecting the relative positioning may also be used without diverging from the invention.

What is claimed is:

1. A printer comprising:

a print assembly configured to deposit droplets of print material on a medium of interest;

a drive mechanism connected to provide relative movement between said print assembly and said medium; and an optical detector having a two-dimensional array of closely spaced sensor elements, said optical detector being fixed relative to said print assembly and having a combination of a resolution, a read frame rate and field of view such that physical characteristics of individual said droplets on said medium are resolvable.

2. The printer of claim 1 further comprising a processor responsive to said optical detector to adjust print quality parameters during a printing operation in which said physical characteristics of imaged individual droplets are detected to be outside of a range of acceptability.

3. The printer of claim 2 wherein said processor is enabled to be responsive to detected dimensions of said imaged individual droplets, said optical detector and processor being cooperative to provide a sufficient resolution to generate from a frame sequence image information in which said dimensions are measurable.

4. The printer of claim 3 wherein said processor is enabled to detect and respond to gyrational information regarding said imaged individual droplets.

5. The printer of claim 3 wherein said processor is enabled to detect and respond to position information regarding droplet position variables for said imaged individual droplets, said droplet position variables being detectable from each said frame sequence of image information in which a droplet is imaged.

6. The printer of claim 5 wherein said position information to which said processor is responsive includes at least one of droplet-centroid information, position-of-peak-light-absorption information, and diameter-intersection information.

7. The printer of claim 1 wherein said print assembly includes an inkjet printhead for projecting said droplets toward said medium.

8. The printer of claim 1 wherein said array of sensor elements includes a plurality of columns in which sensor elements in adjacent columns are offset in a direction perpendicular to said relative movement, said offset being with respect to centers of said sensor elements in said adjacent columns.

9. The printer of claim 8 wherein said columns of sensor elements are grouped as pairs in which circuit traces are routed between said pairs.

10. The printer of claim 1 further comprising at least one source of illumination positioned to illuminate said field of view of said detector, said illumination being at an angle in an approximate range of 20 degrees to 65 degrees relative to a surface normal of said medium.

11. The printer of claim 1 wherein said optical detector includes a diffractive optical arrangement between said medium and said array of sensor elements.

12. A method of monitoring printer processing comprising the steps of:

projecting droplets of print material onto a medium;

forming at least one frame of image information of print on said medium using an optical detector having an array of photosensitive pixels for generating said image information; and identifying physical characteristics of individual droplets represented in said at least one frame, said physical characteristics being specific to geometries of said droplets situated on said medium and being determined using droplet inspection in at least two dimensions.

13. The method of claim 12 wherein said step of identifying physical characteristics includes determining radii of gyration of individual droplets on said medium.

14. The method of claim 12 wherein said step of identifying physical characteristics includes determining a position of at least one of (a) a droplet centroid, (b) an intersection of two perpendicular principal diameters, and (c) peak light absorption.

15. The method of claim 12 further comprising the steps of:

mounting said array of photosensitive pixels for movement with a source of said droplets; and adjusting print quality of said source as a response to detecting changes in said physical characteristics of said droplets on said medium.

16. The method of claim 12 further comprising steps of:

forming said array of photosensitive pixels in an arrangement of adjacent columns having a column-to-column offset in an orthogonal direction to movement of said array relative to said medium, said column-to-column offset being less than or equal to a pitch of said photosensitive pixels in one of said columns; and generating a plurality of said frames at a frame rate that is sufficiently high to limit droplet displacement in successive said frames to a distance that is less than said pitch.

17. A monitoring system mounted in a printer which forms printed matter in a sequence of microscopic dots, said monitoring system comprising:

a two-dimensional array of photosensitive pixels;

an optical assembly that is cooperative with said array to define a field of view in which resolution is sufficient to image two-dimensional geometric features of individual said dots residing on a medium; and a processor connected to receive frames of image information for said array and configured to detect said two-dimensional geometric features of said individual dots from said frames.

18. The monitoring system of claim 17 wherein said array includes columns of said photosensitive pixels in which adjacent columns are offset in a direction perpendicular to a relative movement between said array and said medium on which said dots reside, such that spacings between said photosensitive pixels of a first column are offset from spacings between photosensitive pixels of a second column that is adjacent to said first column.

19. The monitoring system of claim 18 wherein said processor is configured to maintain a frame rate such that dot displacement in successive frames is less than a pitch of said photosensitive pixels, where said pitch is measured in a direction parallel to said columns.

20. The monitoring system of claim 17 wherein said processor is configured to recognize specific positions with in an interior of said individual dots.

21. The monitoring system of claim 17 wherein said optical assembly includes a light source and includes a lens, said light source being directed to illuminate said field of view and said lens being positioned between said array and said medium.

22. The monitoring system of claim 17 wherein said two-dimensional array of photosensitive elements is formed of a plurality of modules of said photosensitive elements.

23. The monitoring system of claim 17 wherein said array includes columns of said photosensitive pixels, said array being tilted around an axis parallel to said columns, said tilt being relative to said medium, said processor being configured to select among said columns in determining which group of said photosensitive pixels yields image information which is perceived as being reliable.

24. A method of monitoring printer processing comprising the steps of:

forming stealthy marks on a print medium;

utilizing an optical detector that is mounted for movement with a print cartridge to image said stealthy marks, said optical detector including a two-dimensional array of photosensitive elements; and basing parameters of printing operations on images of said stealthy marks generated using said optical detector.

25. The method of claim 24 wherein said step of forming said stealthy marks is a step of depositing stealthy dots using said print cartridge, said print cartridge being an inkjet printhead.

26. The method of claim 25 wherein said step of basing said parameters of said printing operations on said images includes determining areas in which to print visible material on said print medium, said determining being dependent upon locations of said stealthy dots.

27. The method of claim 26 wherein said step of determining said areas includes identifying printable areas on a pre-printed form, said pre-printed form being said print medium.

28. The method of claim 24 wherein said step of basing said parameters of said print operations includes correlating said images of said stealthy marks to known locations of said stealthy marks on said print medium, thereby enabling determinations of said printing operations to be based on identifying said known locations.

* * * * *